US006716149B2

(12) United States Patent
Carnevali

(10) Patent No.: US 6,716,149 B2
(45) Date of Patent: Apr. 6, 2004

(54) POSITIONING FABRIC LABELS FOR THEIR CUTTING AND FOLDING

(75) Inventor: Andrea Carnevali, Carpi (IT)

(73) Assignee: Willy Italiana di Carnevali L. & Diacci E. S.N.C., Carpi (IT)

( * ) Notice: Subject to any disclaimer, the term of this patent is extended or adjusted under 35 U.S.C. 154(b) by 45 days.

(21) Appl. No.: 09/995,590

(22) Filed: Nov. 29, 2001

(65) Prior Publication Data

US 2003/0100425 A1 May 29, 2003

(51) Int. Cl.[7] ..... B31B 1/00

(52) U.S. Cl. ..... 493/22; 493/405; 493/19; 493/23

(58) Field of Search ..... 493/10, 11, 19, 493/22, 23, 25, 405

(56) References Cited

U.S. PATENT DOCUMENTS

| | | | | |
|---|---|---|---|---|
| 3,766,870 A | | 10/1973 | Weigert | |
| 3,986,440 A | * | 10/1976 | Macdonald et al. | |
| 4,474,637 A | | 10/1984 | Kempf | |
| 5,000,725 A | * | 3/1991 | Bauknecht | 493/11 |
| 5,402,619 A | * | 4/1995 | Nelson et al. | 493/19 |
| 5,818,719 A | * | 10/1998 | Brandon et al. | 493/11 |

FOREIGN PATENT DOCUMENTS

| | | |
|---|---|---|
| DE | 197 57 822 | 7/1999 |
| FR | 2 708 580 | 2/1995 |

* cited by examiner

*Primary Examiner*—Eugene Kim
*Assistant Examiner*—Sameh Tawfik
(74) *Attorney, Agent, or Firm*—Browdy and Neimark, P.L.L.C.

(57) ABSTRACT

The labels present a central portion (13) provided with at least one brand name, and two opposing lateral tails (11*b*) folded against the rear face. The method consists of advancing a continuous fabric tape (10) consisting of a succession of label portions (11*n*) joined together, and cyclically halting the tape (10) in such a manner that its front end becomes disposed in a cutting and folding station (30) where it undergoes separation of each label portion (11*n*) from the front end of the tape (10) and folding of the two opposing tails (11*b*) of the label along two fixed folding planes (B1 and B2). Each cycle comprises: determining the length of each label portion (11*n*) by sensing, at a fixed point of the path, the passage of a predetermined corresponding point (13') of each label (11*n*) in succession; advancing the tape (10) under the control of an encoder means; and halting each label within the folding station in a position in which the central portion is in constant geometrical relationship with the fixed folding axes (B1 and B2), following processing of the determined value representing the length of the label portion (11*n*).

5 Claims, 2 Drawing Sheets

POSITIONING FABRIC LABELS FOR THEIR CUTTING AND FOLDING

BACKGROUND OF THE INVENTION

1. Technical Field of the Invention

This invention relates to the positioning, for cutting and folding purposes, of fabric labels for articles of clothing, shoes, hats, bags and similar articles, of the type presenting a central portion provided with at least one brand name, and two opposing lateral tails folded against the rear face of the label.

2. Prior Art

Labels are currently produced from tapes of indeterminate length, each of which comprises a succession of joined-together label portions (i.e. label portions containing the brand name and all the required elements of the label), which when separated give rise to that number of labels.

The tape is cyclically halted such that is front end lies in a cutting and folding station in which each label portion is separated from the front end of the tape and the opposing tails of the label obtained in this manner are folded along two fixed folding planes.

The tape end is positioned by stops woven into the tape between one label portion and the next. Each of these stops is moved, one at a time, to coincide with the cutting plane, and at this point the tape is halted. Here the tape is cut, and immediately afterwards the two tails of the label are folded.

However, it happens in practice that as the tape is of fabric, the length of the label portions is not constant at each point of the tape. In this respect, the weaving produces some sections in which the length of the label portions is greater than in other sections.

Hence, although the position of the cutting plane is in fixed geometrical relationship with the fixed folding axes, when the label length varies it can happen that in the final label the central portion, which carries the brand name, lies in a position eccentric to the two folding lines. This produces an undesirable or indeed unacceptable appearance.

OBJECT OF THE INVENTION

An object of the present invention is to overcome said drawback by a method and relative system for correctly positioning the front end of the tape such that the central portion of each label lies in constant geometrical relationship with the fixed folding axes, and in particular such that the centre line of the central portion lies on the central axis at the same distance from the fixed folding axes.

BRIEF DESCRIPTION OF THE DRAWINGS

The invention is described in detail hereinafter with the aid of the accompanying figures which illustrate a non-exclusive embodiment thereof by way of example.

DETAILED DESCRIPTION OF THE PREFERRED EMBODIMENT(S) OF THE INVENTION

Figure 1:
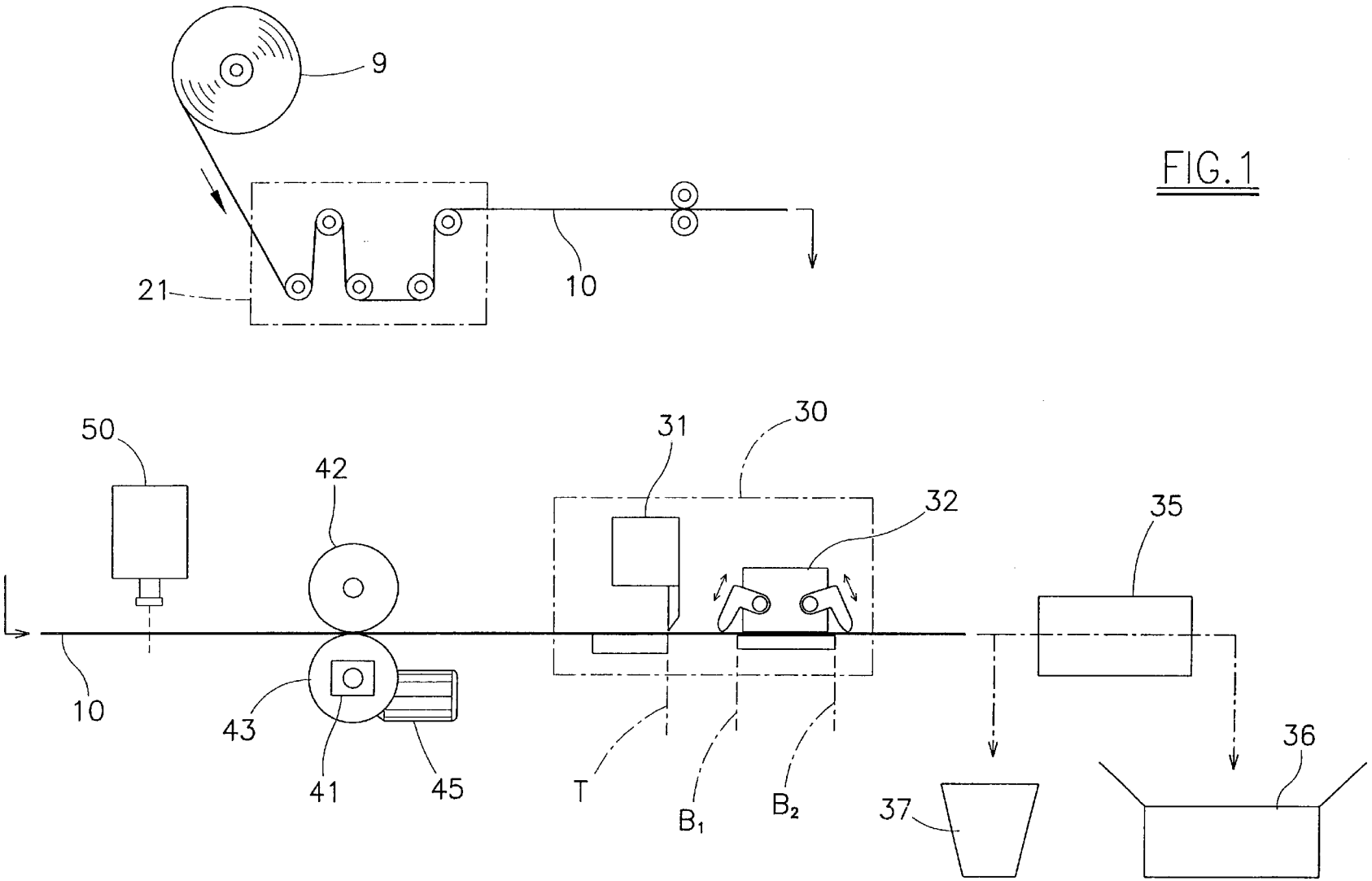
FIG. 1 is a schematic view of a plant for implementing the method of the invention.
Figure 2:
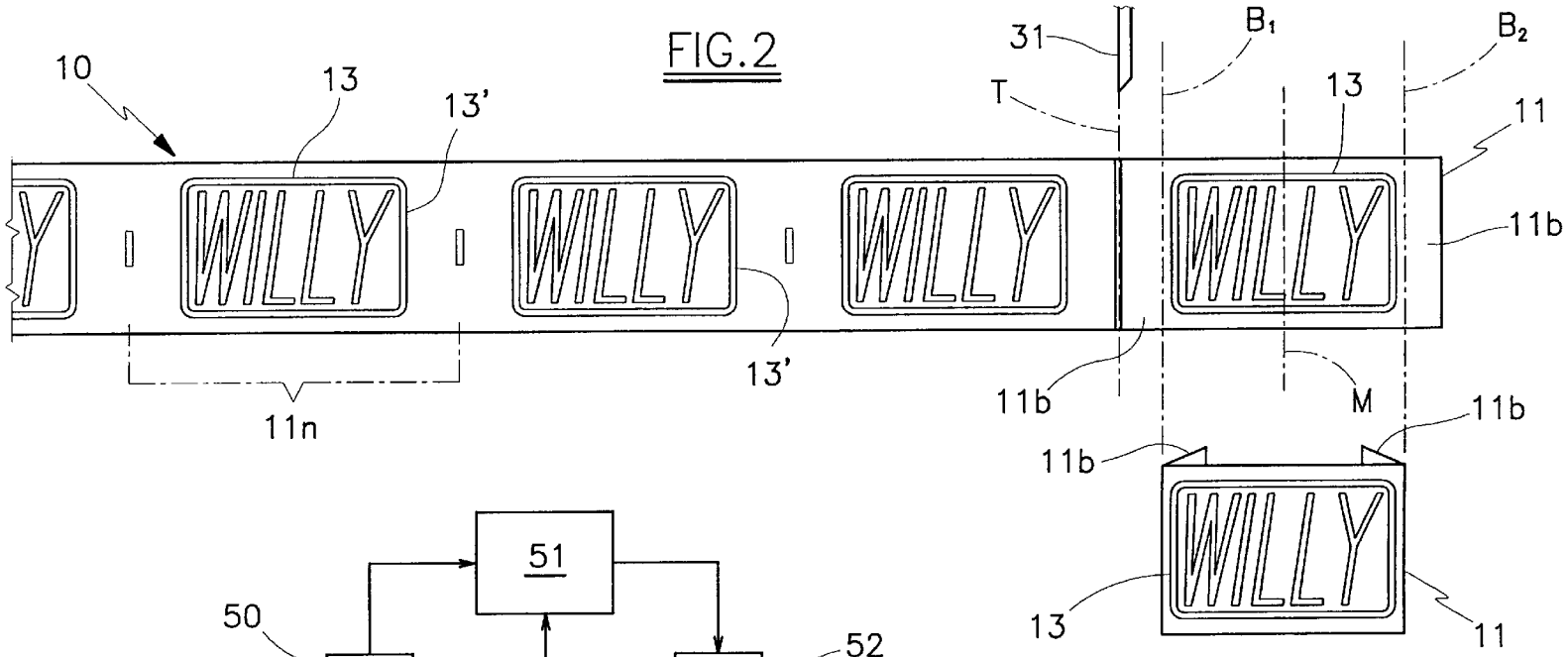
FIG. 2 is a plan view of the tape carrying the labels, and undergoing certain operations in the plant of FIG. 1.

FIG. 2 shows the final label (indicated by 11) obtained by the invention. The label 11 carries woven (or printed) on its exposed face a central portion 13 provided with at least one brand name and possibly other signs, and presents two opposing lateral tails 11*b* which are folded through 180 degrees against the rear face.

The labels reach the plant in the form of a longitudinal tape 10 carrying a plurality of label portions 11*n* positioned one after another in succession and joined together to form the single tape 10.

Said tape can be obtained in traditional manner, i.e. from a large piece of fabric containing a plurality of parallel longitudinal rows of labels, which is then cut along longitudinal cutting lines.

In the illustrated plant, the tape 10 unwinds upstream from a reel 9 positioned with its axis horizontal, and is initially guided by a group 21 of rollers arranged to put the tape 10 under tension and in its correct geometrical configuration. Downstream of the group 21 the tape 10 travels with its exposed face upwards through a rectilinear horizontal distance.

Downstream of the group 21 there can be provided means (of known type, not shown in the figures) for performing certain operations on the tape 10. In the final part of the plant there is provided a cutting and folding station in which each label portion 11 is separated from the front end of the tape 10 by a cutting machine 31, and folded by a machine 32 which folds the two opposing tails 11*b* along two fixed planes B1 and B2.

Figure 3:
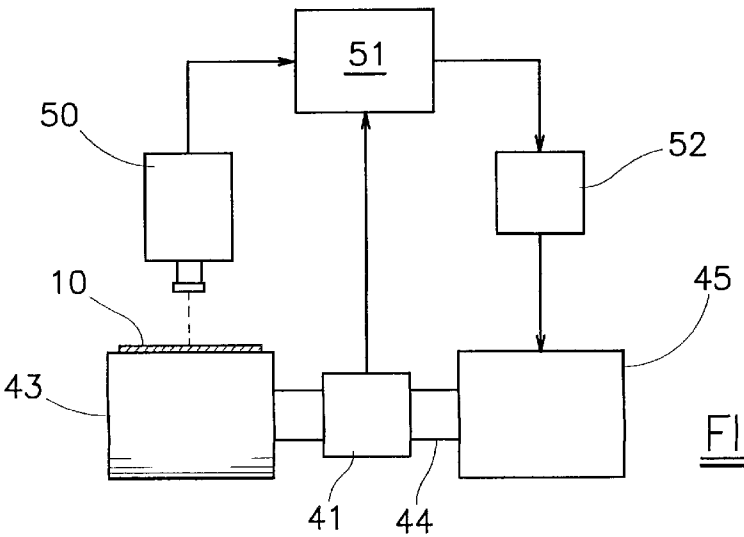
FIG. 3 is a block diagram of the positioning system provided in the plant of FIG. 1.

The system for positioning the label portions 11*n* in the station 30 comprises means for controlling by an encoder 41 the advancement of the tape 10. Specifically, a pair of opposing rollers 42 and 43 is provided for advancing the tape 10, the lower roller 43 being motorized by a motor (see FIG. 3), the shaft 44 of which is controlled by the encoder means 41. The position of the tape 10 is kept constantly under control by said means. Along the path of the tape 10 upstream of the station 30 there is positioned at least one optical sensor means 50 at a fixed distance from the fixed folding axes B1 and B2, to sense the passage of a predetermined corresponding point of each label portion in succession. For example, as in the example shown in the figures, the means 50 is arranged to sense the front transverse segment 13' (front in relation to the direction of advancement of the tape 10) which defines the front side of the border bounding the central portion 13.

There is also provided a processor means (microprocessor) 51 arranged to process the data originating from the sensor means 50 and from the encoder means 41 and to consequently control the advancement of the tape 10 via a driver circuit 52 for the motor 45.

The control system acts in the following manner.

The sensor means 50 senses the passage of each predetermined corresponding point 13' of the tape 10 (i.e. the segment 13') below the sensor 50. The length of the label portion 11*n* is calculated with sufficient accuracy from two consecutive sensings in combination with the data provided by the encoder means 41, as the distance between two corresponding points (two segments 13') of the tape 10 is measured; the label portion 11*n* does not lie exactly between two points 13', however their distance apart indicates the length of the label portion 11*n* with sufficient accuracy.

After calculating the length of the label portion 11*n*, the processor means 51 halts the tape 10 such that each label portion 11*n* halts in the folding station 30, in a position in which its central portion lies in constant geometrical relationship to the fixed folding axes B1 and B2. Each label portion 11*n* is specifically halted in the cutting and folding station 30 such that the centre line of the central portion 13 lies on the central axis M which lies at the same distance from the fixed folding axes B1 and B2. In one embodiment, the tape 10 is halted after each label portion 11*n* has passed through a length from the location of the sensor 50 equal to:

$K+(\frac{1}{2}\times L_t\times A)$, where:

K is the distance between the position of the point at which the sensor means 50 lies and the central axis M (K is a fixed value independent of the position of the means 50), $L_t$ is the total length of the label portion, measured after two consecutive passages, A is a fixed value, substantially constant in each tape 10, which indicates the ratio of the length of the intermediate portion 13 of the label portion to the total length $L_t$ ($A\times L_t$ is substantially equal to the length of the portion 13).

On each label portion 11*n*, halted in this manner in a centered position about the fixed axes B1 and B2, a cut is made through the tape 10 in the cutting plane T such as to separate the label portion 11*n* from the tape and fold the two tails 11*b* along the two planes B1 and B2.

Downstream of the station 30 there is positioned a hot ironing device 35 which reinforces the folding of the two tails 11*b* of the label portion 11*n*. Finally, any defective labels 11 are separated and collected in the container 37, while the others are collected in a pack 36.

In the final label 11 obtained, the central portion 13 is exactly centered between the two folding lines of the tails 11*b*, as is required. The two tails 11*b* can have different lengths, but this is of no importance as it does not alter the appearance of the label, the two tails being hidden.

Numerous modifications of a practical and applicational nature can be made to the invention, but without leaving the scope of the inventive idea as claimed below.

What is claimed is:

1. A method for positioning, for cutting and folding purposes, fabric labels for articles of clothing, shoes, hats, bags and similar articles, said labels presenting a central portion (13) containing at least one brand name or similar signs, and two opposing lateral tails (11*b*) folded against the rear face of the central portion, comprising:

advancing a continuous fabric tape (10) consisting of a succession of label portions (11*n*) joined together, cyclically halting the tape (10) in such a manner that its front end becomes disposed in a cutting and folding station (30) where it undergoes separation of each label portion (11*n*) from the front end of the tape (10) and folding of the two opposing tails (11*b*) of the label along two fixed folding planes (B1 and B2), a position of a cutting plane being in fixed geometrical relationship with fixed folding axes, characterised by comprising, in each cycle:

determining the length of each label portion (11*n*) by sensing, at a fixed point of the path, the passage of a predetermined corresponding point (13') of each label portion (11*n*) in succession;

advancing the tape (10) under the control of an encoder means; and halting each label portion (11*n*) within the folding station in a position in which the central portion (13) is in constant geometrical relationship with the fixed folding axes (B1 and B2), following processing of the determined value representing the length of the label portion (11*n*).

2. A method as claimed in claim 1, characterised in that each label portion (11*n*) is halted in the folding station (30) such that the centre line of the central portion (13) of the label portion (11*n*) lies on the central axis (M) at the same distance from the fixed folding axes (B1 and B2).

3. A method as claimed in claim 1, characterised in that each label portion (11) is halted in the folding station (30) by controlledly advancing the tape (10) through a distance, measured from the fixed sensing point, which is a function of the distance of the sensing point from the fixed folding axes (B1, B2) and of the determined length of the label portion (11*n*).

4. A system for positioning labels for their cutting and folding as claimed in claim 1, in a plant comprising a cutting and folding station (30) in which the two opposing tails (11*b*) of the label portion (11*n*) are folded along two fixed folding planes (B1, B2), characterised by comprising:

means for controlling by an encoder (41) the advancement of the continuous tape (10), at least one sensor means (50) positioned at a fixed distance from the fixed folding axes (B1, B2) to sense the passage of a predetermined corresponding point (13') of each label portion (11*n*) in succession, a processor means (51) for processing the determined value representing the length of the label portion (11*n*) and for consequently controlling the advancement of the tape (10).

5. A system as claimed in claim 4, characterised in that the tape (10) is advanced by a pair of advancement rollers (42, 43), of which one roller (43) is motorized and its shaft (44) controlled by an encoder means (41).

* * * * *